US008432281B2

(12) United States Patent
Reese et al.

(10) Patent No.: US 8,432,281 B2
(45) Date of Patent: Apr. 30, 2013

(54) PORTABLE BOUNDARY SENSOR SYSTEM AND METHOD

(75) Inventors: James T. Reese, Logan, UT (US); Rickey D Hughes, Providence, UT (US)

(73) Assignee: Utah State University, Logan, UT (US)

( * ) Notice: Subject to any disclaimer, the term of this patent is extended or adjusted under 35 U.S.C. 154(b) by 302 days.

(21) Appl. No.: 12/839,633

(22) Filed: Jul. 20, 2010

(65) Prior Publication Data

US 2011/0012734 A1 Jan. 20, 2011

Related U.S. Application Data

(60) Provisional application No. 61/226,773, filed on Jul. 20, 2009.

(51) Int. Cl.
*G08B 13/00* (2006.01)

(52) U.S. Cl.
USPC ..... 340/541; 340/540; 340/552; 340/555; 340/556; 340/557; 340/545.1; 340/564; 340/628

(58) Field of Classification Search ..... 340/541, 340/540, 552, 555–557, 545.1, 564, 628
See application file for complete search history.

(56) References Cited

U.S. PATENT DOCUMENTS

| | | | | |
|---|---|---|---|---|
| 3,623,057 | A * | 11/1971 | Hedin et al. | 340/557 |
| 3,711,846 | A * | 1/1973 | Schlisser et al. | 340/557 |
| 4,910,498 | A * | 3/1990 | Feher | 340/556 |
| 5,892,446 | A | 4/1999 | Reich | |
| 5,980,123 | A | 11/1999 | Heifler | |
| 6,130,615 | A * | 10/2000 | Poteet | 340/573.6 |
| 6,650,239 | B1 | 11/2003 | Hron | |
| 6,774,790 | B1 * | 8/2004 | Houston | 340/556 |
| 6,806,811 | B1 | 10/2004 | Readler | |
| 6,816,073 | B2 | 11/2004 | Vaccaro et al. | |
| 7,079,027 | B2 | 7/2006 | Wojcik | |
| 7,218,235 | B1 | 5/2007 | Rainey | |

* cited by examiner

*Primary Examiner* — Tai T Nguyen

(57) ABSTRACT

A method and system that creates a boundary with an alert and deterring function when the boundary is crossed. The system employs a base unit and one or more portable IR motion sensors which are capable of discriminating between objects of differing physical characteristics, and notifies the user when the parameters for sufficient obstruction have been met. Both sensors and base unit have audio and visual deterring capabilities to frighten away unwanted intruders. The method and system can be utilized in camping situations to deter dangerous wildlife and can be configured to notify users when children exit from an area. The system can be used to create a contiguous perimeter, or any boundary arrangement desired.

32 Claims, 5 Drawing Sheets

PORTABLE BOUNDARY SENSOR SYSTEM AND METHOD

RELATED APPLICATIONS

This application claims the benefit under 35 U.S.C. §119 (e) of U.S. Provisional Patent Application No. 61/226,773, filed Jul. 20, 2009, and titled "Portable Boundary Sensor System and Method" which is incorporated herein by reference.

FIELD OF THE INVENTION

This invention relates to a portable method and system for establishing a given boundary by configuring a set of infrared motion sensors. The system also implements an audio and visual alarm when the parameters for sufficient obstruction of the boundary are met. Applications include but are not limited to, guarding against dangerous wildlife while camping, confining children to a specified area or protecting intrusion into a dangerous area.

BACKGROUND OF THE INVENTION

Camping in the outdoors can create unwanted encounters with dangerous wildlife such as bears, moose, elk, or other intruders. These intruders often enter campsites in the evening when campers are asleep or during the day when campers may be distracted by other activities. By the time the campers realize the intruder is in the camp, it may be too late to prevent serious injury or death.

In another scenario, sometimes a child play area is by necessity near a dangerous area. In the absence of a physical boundary, there is need for a boundary sensing method which can alarm when a perimeter is breached.

This system must also be capable of discriminating between objects like, but not limited to small animals, tree branches, balls, etc. and larger, more relevant objects like children, adults, or other larger animals. In order to be useful, the system needs to be easily configurable for a variety of operational environments. The need is to allow movement within a portable boundary, but alert when the perimeter is sufficiently obstructed.

There have been some developments in the arena of motion sensing, but they practically fail to meet this need.

Some systems use a physical boundary which is set up by the user. A physical boundary, like a tripwire, is incapable of distinguishing between the various entities which may trip the wire. Also, once the wire is tripped, the system must be setup again and is inconvenient for perimeter monitoring. In an outdoors environment, large animals may intentionally or unintentionally simply step over the triggering device.

There are other systems which make audible alarms or turn on lights when motion is detected, however they generally fail to discriminate between smaller objects and more significant ones. In an outdoors environment, such a system is not useful if, for example, it cannot distinguish between branches blowing in the wind, and a large animal.

Some systems use lasers to establish a defined perimeter. Although the laser beams allow movement within the perimeter and adequately create a boundary, the system is triggered when there is a break in the beam or link between two sensors. This beam may be broken by either small or large objects and a laser based system cannot distinguish between the two. Additionally, would be intruders may simply miss the beam and cross the perimeter without triggering the system. Lasers are also impractical for a variety of settings because they require large amount of power not generally available to a portable user.

Arrays of infrared sensors are sometimes used to monitor a given boundary. Although this type of method, monitors movement on a given boundary, it still cannot discriminate between the movement of irrelevant objects and larger ones. Currently designed systems are expensive, require permanent installation and amount of power not generally available to a portable user. Also, in this scenario, the individual sensors do not cooperate and include no deterrent.

There is a need for a boundary system that is capable of differentiating between acceptable movement by irrelevant objects and larger objects of interest in a wide variety of environments. The system should be able to immediately alert users, or deter intruders, be portable, lightweight and easy to set up.

SUMMARY OF THE INVENTION

The present disclosure describes a system and method for a portable infrared motion sensor detector and deterrent device. The system utilizes portable infrared motion sensors that establish a perimeter or boundary to detect the intrusion of unwanted visitors or to prevent the exit of a person or child from a designated area. The system notifies the user when the perimeter has been breached and is optionally equipped to emit a loud audio warning signal, bright flashing lights, or both to deter unwanted intruders.

The system is composed of one base unit and multiple portable motion sensors. The to portable motion sensors can be free standing, or they can be mounted to a tree or other type of structure, providing a flexible and easy set up. The number of portable sensors used is limitless which allows for an expandable perimeter or boundary. The base unit can be adjusted to turn either the audio alarm or the light alarm, on or off.

The base unit does not need to be within the perimeter in order for the system to work, allowing the user to move away from the location and still be alerted if the perimeter is sufficiently obstructed. This can be accomplished by a variety of means, including, but not limited to a personal electronic devices, wireless Internet devices or other form of wireless communication.

The power supply for the system can be either a battery or a household electrical outlet. In a more remote environment, solar power may be used. Each portable sensor can be configured to fan out from its origin to the end of its reach. This eliminates the need for precise alignment making it quicker and easier to set up. The infrared motion sensors create an accurate detection system for the movement of objects of a configurable size.

In order to discriminate between objects, this system incorporates portable sensors which self calibrate to their current environment and also recognize an object's temperature. Parameters like time delay, sensitivity, and field of view can be adjusted for each sensor in order to define a level of sufficient obstruction. The time delay parameter allows the user to specify an amount of time that the defined boundary is obstructed before the alarm will sound.

The sensitivity parameter allows the user to configure the amount of obstruction present before the system triggers the alarm. This is another way in which the system can discern the size of an object which is obstructing the boundary.

The field of view parameter allows the user to configure the precise space which the sensor will monitor. For example, setting the field of view to only monitor space above ground configures the system to ignore objects which are smaller and can easily pass below the boundary. Combining these parameters allows the user to define sufficient obstruction which eliminates faulty alarms from the movement of objects which the user does not wish to monitor.

In the same way a perimeter can be created around a campsite, a perimeter or boundary can be created to provide a warning when children exit a designated area and the system will not be triggered by inanimate objects like balls or toys, or smaller animals such as, but not limited to birds, squirrels or cats. The portable perimeter system can be utilized to warn of breaches from outside into the perimeter and from inside out of the perimeter. The sensors may also be independently configured so that different alarms may sound depending on the nature of the object which obstructed the boundary.

BRIEF DESCRIPTION OF THE DRAWINGS

Understanding that drawings depict only certain preferred embodiments of the invention and are therefore not to be considered limiting of its scope, the preferred embodiments will be described and explained with additional specificity and detail through the use of the accompanying drawings in which.

DETAILED DESCRIPTION OF SELECTED EMBODIMENTS

Figure 1:
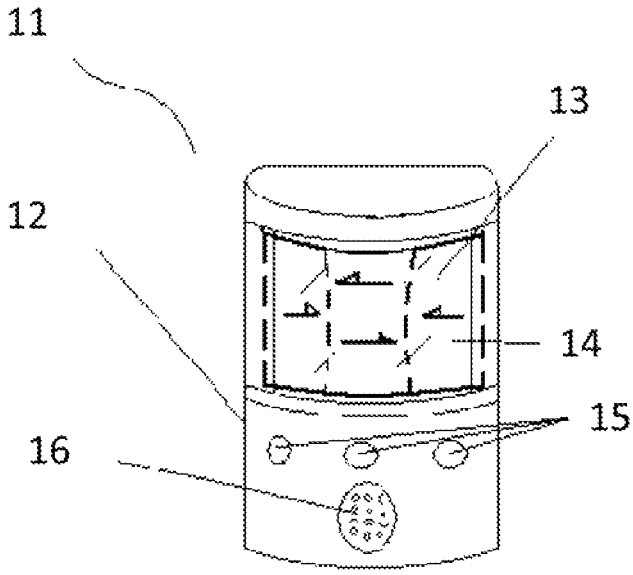
FIG. 1 is the front view of the portable Infrared Motion Sensor showing the LED lights, motion sensor, and speaker alarm. It also shows the adjustable sensor screen, which allows for customization of the field of view parameter for the motion sensor.

In the following description, numerous specific details are provided for a thorough understanding of specific preferred embodiments. However, those skilled in the art will recognize that embodiments can be practiced without one or more of the specific details, or with other methods, components, materials, etc. In some cases, well-known structures, materials, or operations are not shown or described in detail in order to avoid obscuring aspects of the preferred embodiments. Furthermore, the described features, structures, or characteristics may be combined in any suitable manner in a variety of alternative embodiments. Thus, the following more detailed description of the embodiments of the present invention, as represented in the drawings, is not intended to limit the scope of the invention, but is merely representative of the various embodiments of the invention. The invention will be first described referring to establishing a security perimeter while camping in the outdoors and secondly as a boundary establisher to protect children from dangerous areas.

The occurrence of animal attacks on campers in the outdoors has developed a need for a portable boundary security system to warn users of an intrusion and to frighten away dangerous wildlife from campsites, but simultaneously allows the movement of smaller, less dangerous objects. It is important that the boundary system distinguish between the movement of irrelevant objects, such as tree branches or small animals, and larger more relevant wildlife. The disclosed portable security system utilizes a lightweight, reliable, low-power, and easy to set up apparatus that provides safety and security to campers in the outdoors.

Figure 2:
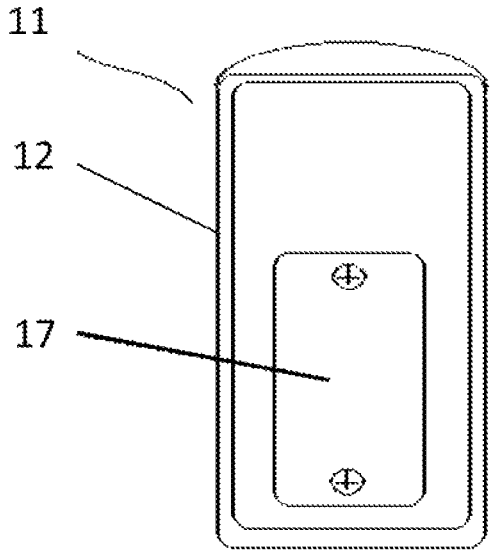
FIG. 2 is a rear view of the portable IR motion sensor showing the battery compartment.

The portable security system utilizes one or more portable infrared motion sensors, 11, shown in FIGS. 1 and 2 which have a housing, 12, which can be but is not limited to plastic. The IR motion sensors, 11, contain a light source shown as a series of LED lights, 15, on the sensor and a speaker, 16, for an audio alarm as shown in FIG. 1. FIG. 2 shows that the portable motion sensors, 11, have a battery compartment, 17, to enable portability, but they can also be plugged into an electrical outlet if desired. The motion sensor's batteries can be rechargeable. The sensor(s) can be positioned on trees or similar structures, or they can be set up as a free standing sensor. This flexibility of sensor positioning allows for an easy set up that provides a customized boundary according to the needs of the camper. The motion sensors are configured to wirelessly communicate and transmit information to a base unit or station when the field of view is obstructed by the movement of an object.

Figure 3:
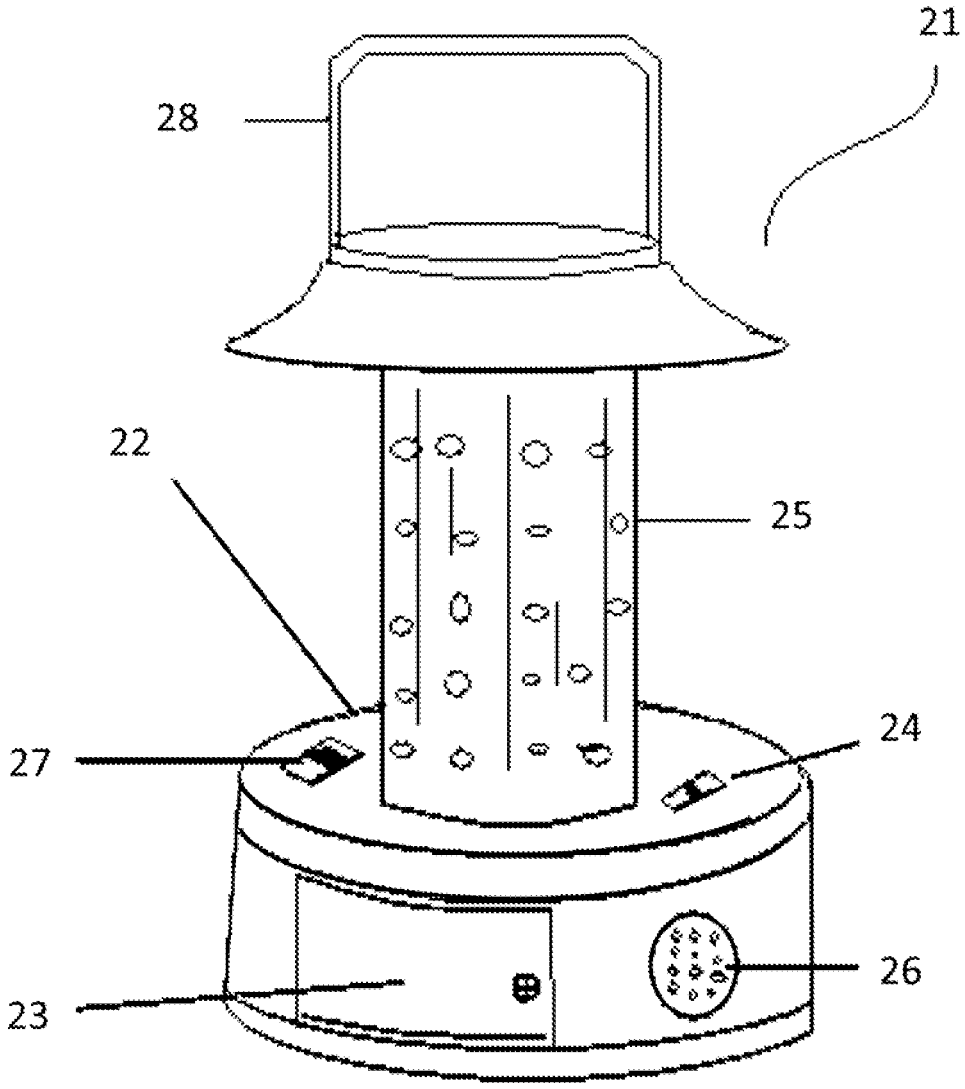
FIG. 3 is an embodiment showing the Base Unit and reveals the LED light source; on/off switch; function switch for the audio alert, visual alert, and light source for lantern; speaker alarm; battery compartment; and a handle for convenience.

One example of a base unit, 21, of the perimeter security system, as shown in FIG. 3, employs a receiver used to receive messages from the portable IR motion sensors, 11, and is held together by a housing, 22, which can be composed of but is not limited to plastic. The base unit, 21, communicates a perimeter breach to the user via either a visual, 25, usually a light, or audio signal, 26. In addition to LEDs illuminating on the sensor that triggered the signal, LEDs can also be positioned on the base unit, 21, to indicate which motion sensor triggered the alarm.

The audio signal, 26, can be, but is not limited to an audio message stating which motion sensor triggered the alarm, or a specific audio signal can be assigned to each sensor which is unique from the other sensors. This allows a user to create several independent perimeter types with different alarms. For example a user could specify different alarms for small or large intruders. In one embodiment, the base unit, 21, can also double as a lantern for regular lighting use. This provides functionality to the base unit as well as security. The handle, 28, provides a means for portability to the base unit. The base unit does not need to be within the perimeter or sensor boundary in order to detect a signal from the motion sensors. In another embodiment the base unit can be a key fob size device. This is another configuration that works identical to the previously described embodiment except without the lantern style lights.

The base station also has transmitting capabilities. This allows campers to be notified of a perimeter breach while they are not within the campsite. The transmitting capability can be but is not limited to sending a message to a personal electronic device such as but not limited to cellular phones, computers, personal digital assistants, and pagers. The base unit also incorporates both visual, 25 and audio signal, 26, capabilities to alert campers of a breach and frighten away wildlife. The visual capability can be but is not limited to a light source, 25.

As shown in FIG. 3 the series of LED lights, 25, provide a light source, which creates a bright flashing light to frighten away wildlife. The audio signal can be but is not limited to an alarm from a speaker, 26 as shown in FIG. 3. The portable boundary sensor system is capable of operating with only the visual alarm, only the audio alarm or both as shown by the functional switch, 27, in FIG. 3.

The system may also be configured to use a variety of transmission frequencies, typically RF, such that multiple networks of sensors may be used in a common area without interfering with each other.

The functional switch, 27, also turns on the light source, 25, for regular lantern use. The functional switch, 27, provides customization of the alarm, so that the alarm can be turned off during the day if desired, or the alarm can be tailored to the desires of the user. Once the alarm is sounded because of a signal from the portable IR motion sensors, the alarm remains on until a specified amount of time has passed in which the portable IR motion sensor has not detected any motion. When this specified time of no motion has passed, the alarm on the sensor and on the base unit automatically resets. The specified amount of time can be adjusted according to the needs and desires of the user. The base unit, 21, can also be turned off via the power switch, 24, shown in FIG. 3.

When motion is detected and an alert signal is sent to the base unit, 21, the light source, 15 and the audio signal, 16, on the motion sensor is also initiated. The sensors are customizable for turning on or off either the light source, 15, and/or the audio signal, 16. The light source, 15, and audio alarm, 16, are designed to frighten away wildlife near the sensor.

In order to discriminate between objects, the system incorporates portable sensors which self calibrate to their current environment and also recognize an object's temperature. Parameters like time delay, sensitivity, and field of view can be adjusted for each sensor in order to define a level of sufficient obstruction. The time delay parameter is managed by a microcontroller in the base station and allows the user to specify an amount of time that the defined boundary is obstructed before a warning signal is emitted. This results in the system not generating a warning and ignoring the effects of objects which obstruct the boundary only briefly.

The sensitivity parameter allows the user to configure the amount of obstruction present before the system triggers the alarm. When the obstruction level exceeds a user defined threshold value, a signal is wirelessly sent to the base unit. This is another way in which the system can discern the size of an object which is obstructing the boundary. Setting the sensitivity higher configures the system to ignore the effects of small objects.

The field of view parameter allows the user to configure the precise space which the sensor will monitor. For example, setting the field of view to only monitor space above ground configures the system to ignore objects which are smaller and can easily pass below the boundary.

Combining the time delay, sensitivity, and field of view parameters allows the user to define sufficient obstruction levels for generating a warning signal. This adjustability allows the user to set detection ranges and thus eliminate faulty alarms from the movement of objects which the user does not wish to monitor.

Figure 5:
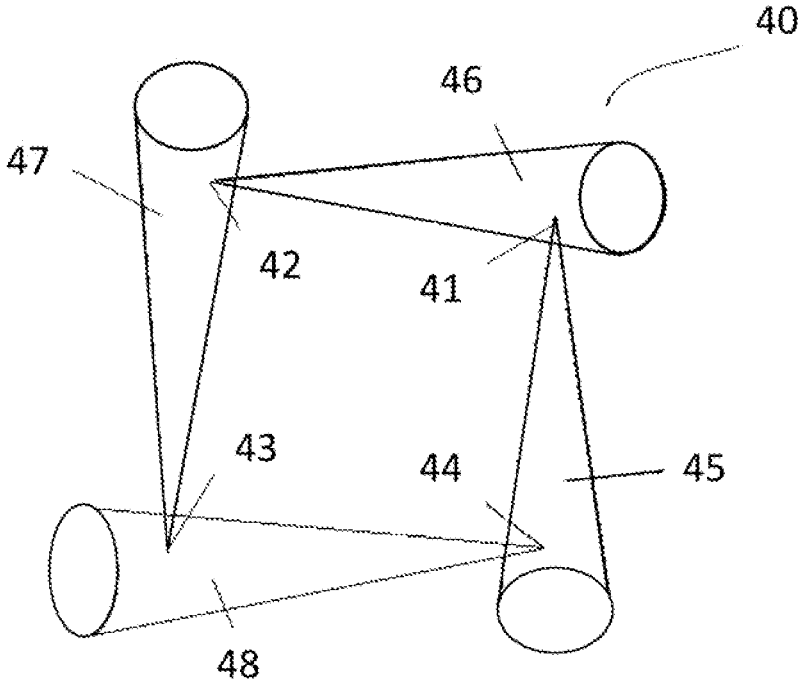
FIG. 5 is an arrangement of 4 portable sensors to create a defined perimeter. This is another possible arrangement of sensors.
Figure 6A:
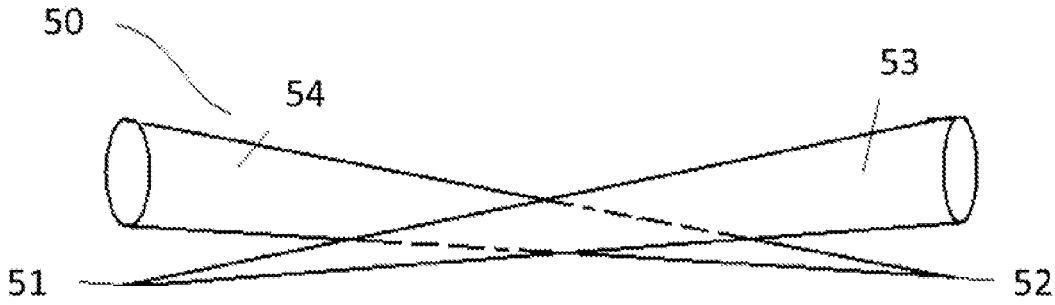
FIGS. 6*a* and 6*b* reveal how a boundary can be formed using two sensors. These boundaries can be established in front of any precarious environment desired. Different angles can be created with the fields of view of the two sensors.
Figure 6B:
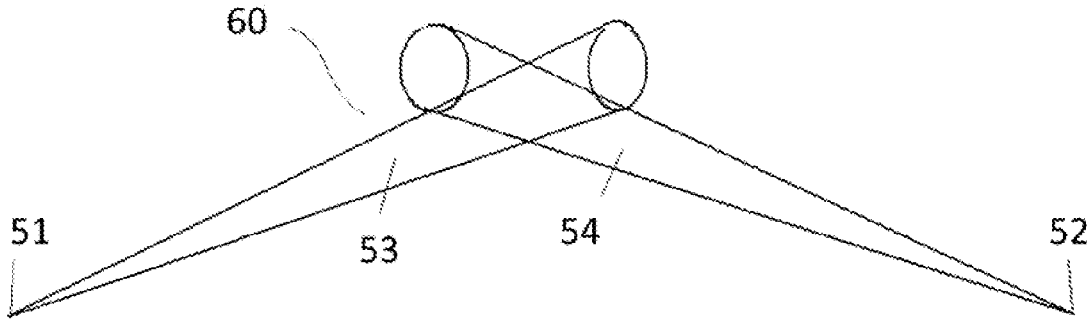
Figure 7:
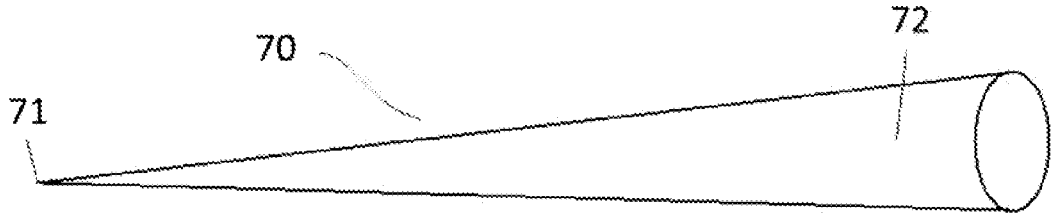
FIG. 7 shows how a boundary can be formed with only one portable motion sensor. The diagram also displays how the field of view of the sensor expands as it increases in distance from the origin.

FIGS. 4, 5, 6*a*, 6*b*, 7, 8, and 9 show several of the unlimited number of possible ways the system can be implemented. FIG. 7 shows the sensor's field of view, 72, spreads out as the distance from the sensor, 71, increases.

Figure 4:
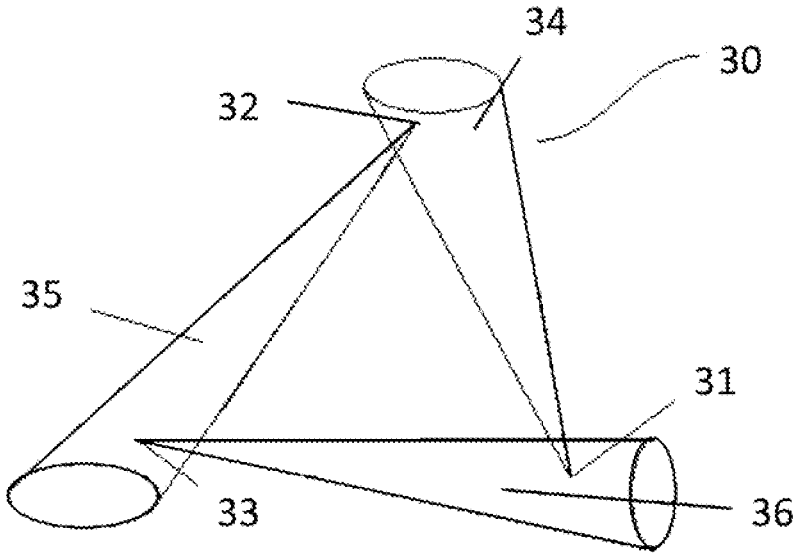
FIG. 4 displays how a perimeter can be easily formed using three portable motion sensors.

This field of view can be altered to customize the area covered by each sensor. This customization is attainable by the sensor screen cover, 14, shown in FIG. 1. The sensor screen cover, 14, can be adjusted to customize the field of view, 72, of the sensor to the desire of the user. A wider field of view may be necessary when there are obstacles, such as trees in the path of the sensor that may block a portion of the field of view. In order to establish a complete perimeter around the campsite, each sensor must be within the field of view of another sensor, so that the sensors create a continuous perimeter around the campsite as shown in FIGS. 4 and 5.

There are many arrangements that can be used to create a complete perimeter using various numbers of portable motion sensors positioned in series. The following illustrate a few examples of how a perimeter can be established, but it does not limit the varying ways a perimeter can be formed; they are merely examples of how a perimeter can be established. In FIG. 4 three motion sensors are used to create a continuous perimeter, 30. The first portable motion sensor, 31, has a field of view, 34, which encompasses the second portable motion sensor, 32, which has a field of view, 35, which encompasses the third portable motion sensor, 33, which has a field of view, 36, which encompasses the first portable motion sensor, 31. FIG. 5 shows how four motion sensors can be employed to create a continuous perimeter, 40. The first portable motion sensor, 41, has a field of view, 45, which encompasses the second portable motion sensor, 44, which has a field of view, 48, which encompasses the third portable motion sensor, 43, which has a field of view, 47, which encompasses the fourth portable motion sensor, 42, which has a field of view, 46, which encompasses the first portable motion sensor, 41. A natural or man-made boundary can also be used as one side of a perimeter to provide a continuous perimeter with the motion sensor boundaries.

Figure 8:
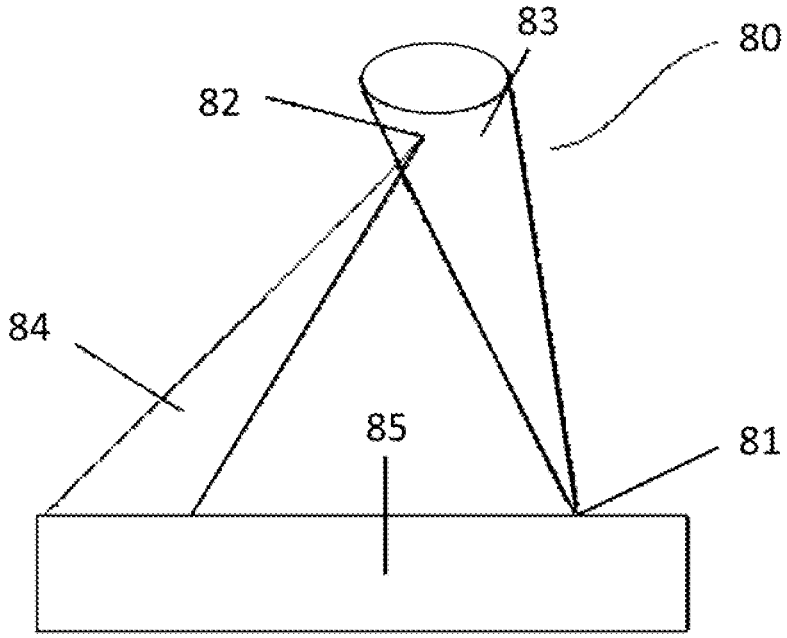
FIG. 8 displays how a natural or man-made barrier can be used along with 2 portable motion sensors to establish a security perimeter.
Figure 9:
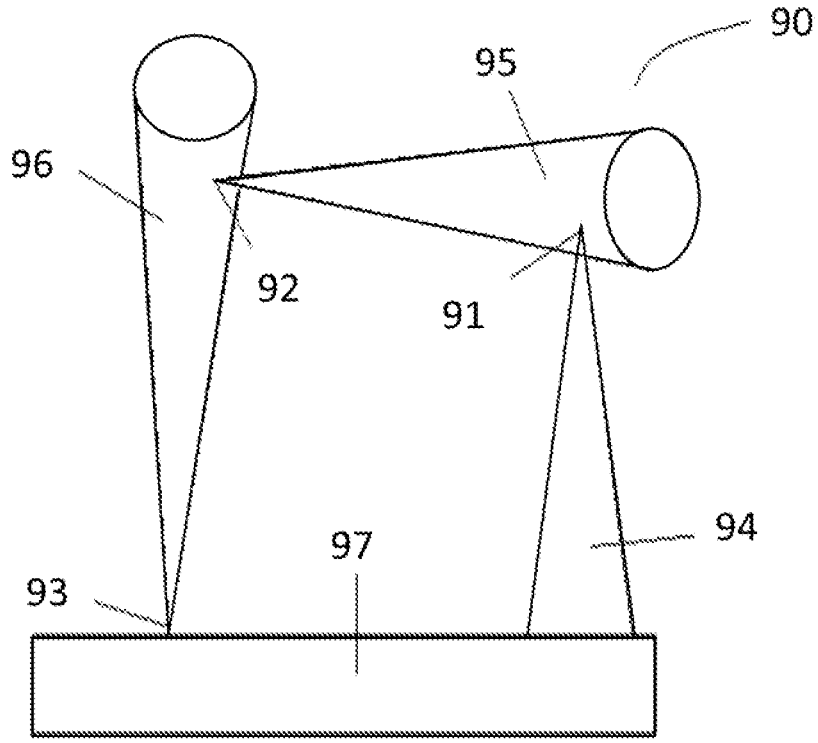
FIG. 9 displays how a natural or man-made barrier can be used along with 3 portable motion sensors to establish a security perimeter.

The natural or man-made boundary could be but is not limited to a rock wall, cliff face, fence, waterfront, or cliff. The sensors don't have to create a complete perimeter when a natural or man-made boundary is employed as one side. The following two examples show how a natural or man-made boundary can be used to create a complete perimeter of security, but it does not limit the variety of possible configurations of sensors and natural or man-made boundaries that can be used to create a continuous perimeter. The examples are merely representations of how this can be accomplished. FIG. 8 shows how two motion sensors, 81, 82, can be used along with a natural or man-made boundary, 85, to form a complete perimeter, 80. The first portable motion sensor, 81, is stationed adjacent to the natural or man-made boundary, 85. The first portable motion sensor, 81, has a field of view, 83, which encompasses the second portable motion sensor, 82, which has a field of view, 84, which ends at the natural or man-made barrier, 85. FIG. 9 shows another arrangement using 3 motion sensors, 91, 92, 93, and a natural or man-made barrier, 97, to create a perimeter, 90. The first portable motion sensor, 93, has a field of view, 96, which encompasses the second portable motion sensor, 92, which has a field of view, 95, which encompasses the third portable motion sensor, 91, which has a field of view, 94, which ends at the natural or man-made barrier, 97. The first portable motion sensor, 93, is adjacent to the natural or man-made barrier, 97. This creates a continuous protective barrier around a designated area.

Another use for the boundary security system is to protect children from entering dangerous areas. One or more of the perimeter IR motion sensors, 11, can be positioned to create a boundary in front of any area where guardians do not want children to go. The boundary would be far enough away from the unwanted area to allow time for the guardian to stop the child. The use of audio and visual alarms from the portable motion sensors and base unit could be employed as in the camping security system to deter the child from crossing the boundary.

The base unit is also capable of transmitting a message to the personal electronic device of the guardian to alert the guardian that the child has crossed the IR motion sensor boundary. This embodiment could be used for dangerous situations such as but not limited to waterways, shorelines, roadways, cliff sides, and other precarious areas. Boundaries that can be created to protect dangerous areas are depicted in FIGS. 6*a*, 6*b*, and 7 but these arrangements do not limit the number of sensors that can be employed nor does it limit the different arrangement possibilities for boundary establishment. In FIG. 6*a* a boundary, 50, is created using overlapping fields of view, 53, 54, from two portable motion sensors 51, 52. The first portable motion sensor, 51, has a field of view, 53. The second portable motion sensor, 52, has a field of view, 54. The field of view, 53, from the first motion sensor, 51, overlaps the field of view, 54, from the second motion sensor, 52. This creates a boundary using two sensors. FIG. 6*b* employs two portable motion sensors that are arranged in a different angle than FIG. 6*a* to provide a different overlap of the fields of view, 60. A single motion sensor can be used to create a boundary in front of a dangerous area. In FIG. 7 a boundary is formed, 70, using a single portable motion sensor, 71, which has a field of view, 72.

Without further elaboration, it is believed that one skilled in the art can use the preceding description to utilize the invention to its fullest extent. Therefore the examples and embodiments disclosed herein are to be construed as merely illustrative and not a limitation of the scope. It will be obvious to those skilled in the art that many changes, such as types of materials and component shapes, may be made to the details of the above described embodiments without departing from the underlying principles of the invention.

What is claimed is:

1. A boundary warning device comprising:

one or more portable motion sensors, each sensor having a field of view, and each with sensitivity adjustment and wireless transmission capabilities;

said motion sensors positioned in a series including at least a first sensor and a last sensor, to form a boundary such that each subsequent sensor is located within the field of view of a previous sensor in the series, and the first sensor is within the field of view of the last sensor;

a portable base unit, with wireless receiving and transmission capabilities;

said motion sensors in communication with said base unit; and a microcontroller in said base unit to analyze information received from said motion sensors, perform object discrimination functions, and trigger a warning when at least one parameter for sufficient boundary obstruction is met.

2. The device of claim 1 wherein said warning is a visible light.

3. The device of claim 1 wherein said warning is an audio signal.

4. The device of claim 1 wherein said warning is both a visible light and an audio signal.

5. The device of claim 1 wherein said warning is a message sent to a mobile phone, land line phone, computer, pager, personal electronic or other communication device.

6. The device of claim 1 further comprising battery sources in said motion sensors and said base unit.

7. The device of claim 1 further comprising an indicator light on each said motion sensor to identify which said motion sensor initiated communication with said base station.

8. The device of claim 1 further comprising an indicator light on said base unit to identify which said motion sensor initiated communication with said base station.

9. The device of claim 1 wherein said object discrimination functions comprise an adjustable time delay parameter that allows field of view obstruction for a user defined period of time before said microcontroller triggers said warning.

10. The device of claim 9 wherein said object discrimination functions further comprise adjustable motion sensitivity parameters.

11. The device of claim 1 wherein the field of view parameter of each said motion sensor can be adjusted.

12. The device of claim 1 wherein said communications between said motion sensors and said base unit is at a selected and adjustable frequency in the radio frequency range.

13. A method for monitoring a breach of a boundary comprising:

creating a boundary by positioning one or more motion sensors, each motion sensor having a field of view, in a series including at least a first sensor and a last sensor, such that each subsequent sensor is located within the field of view of a previous sensor in the series, and the first sensor is within the field of view of the last sensor;

setting a sensitivity parameter on each said motion sensor to a user defined level;

sending a communication signal from one of said motion sensors, that detects motion, to a base unit when a motion threshold level corresponding to said sensitivity parameter of said motion sensor is exceeded for a time;

analyzing the time said motion threshold level is exceeded;

emitting a warning signal if said time is greater than a user defined critical value; and identifying which of said motion sensors initiated said warning signal.

14. The method of claim 13 wherein said warning signal is an audio signal.

15. The method of claim 13 wherein said warning signal is a light signal.

16. The method of claim 13 wherein said warning is both a visible light and an audio signal.

17. The method of claim 13 wherein said warning is a message sent to a mobile phone, land line phone, computer, pager, personal electronic or other communication device.

18. The method of claim 13 wherein said user defined critical value is adjustable.

19. The method of claim 13 wherein an indicator light is illuminated on the sensor that detected the breach to identify which of said motion sensors triggered said warning.

20. The method of claim 13 wherein an indicator light is illuminated on said base unit to identify which of said motion sensors triggered said warning.

21. The method of claim 13 wherein said field of view of each motion sensor can be adjusted to various widths.

22. The method of claim 13 wherein creating said boundary may comprise positioning said field of view a distance above the ground so as not to detect small objects.

23. A method for monitoring a breach of a boundary comprising:

creating a boundary by positioning one or more motion sensors, each sensor having a field of view, in series including at least a first sensor and a last sensor, such that each subsequent sensor is located within the field of view of a previous sensor, and the first sensor is within the field of view of the last sensor;

setting object discrimination parameters;

sending a communication signal from one of said motion sensors, that detects motion, to a base unit when motion is detected;

evaluating said communication signal based on said object discrimination parameters to determine an obstruction level; and emitting a warning signal if said obstruction level is greater than a user defined critical value.

24. The method of claim 23 wherein said discrimination parameters comprise a sensitivity adjustment in said motion sensors and an adjustable delay time in said base unit.

25. The method of claim 23 wherein said warning signal is an audio signal.

26. The method of claim 23 wherein said warning signal is a light signal.

27. The method of claim 23 wherein said warning is both a visible light and an audio signal.

28. The method of claim 23 wherein said warning is a message sent to a mobile phone, land line phone, computer, pager, personal electronic or other communication device.

29. The method of claim 23 wherein an indicator light is illuminated on the sensor that detected the breach to identify which of said motion sensors triggered said warning.

30. The method of claim 23 wherein an indicator light is illuminated on said base unit to identify which of said motion sensors triggered said warning.

31. The method of claim 23 wherein said field of view of each motion sensor can be adjusted to various widths.

32. The method of claim 23 wherein creating said boundary may comprise positioning said field of view a distance above the ground so as not to detect small objects.

* * * * *